US005192819A

United States Patent [19]

Baumgartner

[11] Patent Number: 5,192,819

[45] Date of Patent: Mar. 9, 1993

[54] BULK EXPLOSIVE CHARGER

[76] Inventor: Otto F. Baumgartner, P.O. Box 351, Elkford, British Columbia, Canada, V0B 1H0

[21] Appl. No.: 897,078

[22] Filed: Jun. 11, 1992

[30] Foreign Application Priority Data

Jun. 11, 1991 [CA] Canada ..... 2044311

[51] Int. Cl.[5] ..... F42B 3/00

[52] U.S. Cl. ..... 86/20.15; 102/313; 102/319; 102/323; 102/324; 175/2; 299/13

[58] Field of Search ..... 86/20.15; 102/301, 313, 102/314, 319, 321, 323, 324, 331; 175/2, 62; 299/13

[56] References Cited

U.S. PATENT DOCUMENTS

| | | | |
|---|---|---|---|
| 2,978,947 | 4/1961 | Jeffries | 102/313 |
| 3,040,615 | 6/1962 | Johansson et al. | 102/313 |
| 3,881,417 | 5/1975 | Mesia | 102/22 |
| 4,019,438 | 4/1977 | Swanson, Jr. | 102/24 R |
| 4,250,811 | 2/1981 | Mackey | 102/24 R |
| 4,813,358 | 3/1989 | Roberts | 102/313 |
| 5,007,345 | 4/1991 | O'Garr | 102/313 |
| 5,099,763 | 3/1992 | Coursen et al. | 102/313 |
| 5,105,743 | 4/1992 | Tano et al. | 102/313 |

FOREIGN PATENT DOCUMENTS

| | | |
|---|---|---|
| 677051 | 7/1963 | Canada . |
| 949388 | 6/1974 | Canada . |
| 1062542 | 9/1979 | Canada . |
| 1117865 | 2/1982 | Canada . |
| 1181738 | 1/1985 | Canada . |
| 1214955 | 12/1986 | Canada . |

*Primary Examiner*—J. Woodrow Eldred
*Attorney, Agent, or Firm*—Bull, Housser & Tupper

[57] ABSTRACT

There is disclosed, according to the present invention, an apparatus and method for loading explosives exhibiting little water resistance into water filled blast holes without contamination of the explosives by water. A pressure charger vessel, capable of being filled with bulk explosives of low density and low water resistance, such as ammonium nitrate fuel oil, is connected to a flexible plastic sleeve. A pneumatic plug fixedly connects the lower portion of the pressure charger vessel to the plastic sleeve. The plastic sleeve is lowered into a blast hole by means of a weight. Compressed air is then introduced into the pressure charge vessel and a valve means located between the sleeve and the pressure charger vessel is opened, permitting pressurized ammonium nitrate fuel oil to be pushed downwardly into the flexible plastic sleeve. Projections and recesses on the outer surface of the plastic sleeve facilitate the expulsion of water from the blast hole.

14 Claims, 8 Drawing Sheets

BULK EXPLOSIVE CHARGER

BACKGROUND OF THE INVENTION

This invention relates to a method and apparatus for loading bulk explosives into a blast hole. More particularly, this invention relates to the loading of ammonium nitrate fuel oil into a blast hole which cannot or has not been de-watered.

DESCRIPTION OF THE PRIOR ART

Explosives play an important role in modern open pit mines and their use has a major impact on the production costs. Currently, ammonium nitrate fuel oil (commonly called ANFO) is the most extensively used bulk explosive product. In ANFO, the fuel oil provides the fuel, and the ammonium nitrate provides the oxidizer. ANFO is one of the safest explosives used today because of its low sensitivity to impact, heat, and friction. Moreover, ANFO is relatively inexpensive compared to other explosive products.

Ammonium nitrate fuel oil has two major shortcomings, namely, low bulk strength and lack of water resistance. Gravity loaded ANFO has a density of about 0.84 grams per cubic centimeter, making it lighter than water. Pneumatically loaded ANFO, however, has higher densities resulting in an increase in bulk strength.

ANFO's lack of water resistance causes major difficulties. In many instances, blast holes which are destined to be filled with explosives and detonated, have water in them. This is caused by either surface run-off or underground streams. Such blast holes must be completely de-watered before ANFO can be introduced therein. Exposure of the ANFO to water in a blast hole, coupled with a delay of several hours or days before blasting, can result in a total failure of detonation.

Unfortunately, in many instances, blast holes cannot be de-watered either by reason of the water re-entering between de-watering and loading operations, or by reason of the water entering faster than it can be removed by suitable pumping devices. In addition, the pumping apparatus can freeze up in winter, making de-watering difficult. In cases where blast holes cannot be satisfactorily de-watered, other solutions for the use of ANFO in wet blast holes have been suggested and used. For example, the use of weighted polyethylene hole liners is known. The problem with these polyethylene liners is that they collapse below the water level because ANFO's gravity loaded density is less than that of water. Thus, ANFO can only be loaded into the blast hole down to the level of the water. Obviously, a full column of bulk explosive, placed as designed in a blast hole, is desirable to obtain the type of rock breakup necessary.

ANFO's low bulk strength can be improved with the addition of fuel grade aluminum. When aluminum granules of 5–15% are blended into ANFO as a relatively low cost, high energy fuel, the maximum energy output is increased. Such an explosive is known as AL/ANFO. Unfortunately, this mixture still lacks water resistance.

In more recent times, slurry and emulsion products have been introduced to attain higher bulk strength and water resistance to the ANFO. An emulsion is a two phased system in which an inner or dispersed phase is distributed in an outer or continuous phase. In simple terms, an emulsion is an intimate mixture of two liquids that do not dissolve in one another. Such emulsions or slurries provide varying degrees of water resistance to ANFO in holes that cannot be de-watered. Thickeners are also used to give a gel-like structure and a chemical cross-linking is added which causes the slurries to "harden" in the bore hole. Unfortunately such products must be pumped into bore holes and they are costly to prepare and use.

In Canadian Patent 1,214,955, entitled Methods and Apparatus for Loading a Bore Hole With Explosives, the problem of ANFO's lack of water resistance and low bulk strength is apparently solved by using a thick viscous emulsion and slurry containing a high percentage of ammonium nitrate prills. Although the patent in question does not particularly rely on slurries, the method described therein works only with slurries as porous AN prills readily absorb water and dissolve rapidly, rendering apparatus shown in Canadian Patent 1,214,955, which permits the slurry to exit through the bottom of polyethylene sleeve would not work with ANFO in a non-emulsion or non-slurry form.

SUMMARY OF THE INVENTION

It is therefore an object of the present invention to provide an apparatus and method of loading low cost, cost effective ammonium nitrate fuel oil into blast holes, which are difficult or impossible to de-water by conventional methods, and to protect the ANFO from being contaminated by the ingress of water.

Therefore this invention seeks to provide an apparatus for loading bulk explosives into a cylindrical blast hole comprising:

- a pressure charger vessel adapted to be filled with bulk explosives and pressurized with compressed air;
- at least one water impervious cylindrical flexible sleeve adapted to be lowered into a blast hole and connected to said pressure charger vessel;
- said flexible sleeve including an irregular outer surface with recessions and projections;
- said projections adapted to abut inner walls of said blast hole;
- a pressure means adapted to convey pressurized air into said pressure charger vessel and said sleeve; and
- a conveying means adapted to convey bulk explosives into said pressure charger vessel;

wherein, when in operation, pressurized air is conveyed expanded to substantially fill said blast hole, said sleeve is filled with bulk explosives and pressurized air, simultaneously forcing any water in said blast hole outwards and upwards between inner walls of said blast hole and said recessions on the outer surface of said sleeve, thereby permitting said sleeve to be filled with explosives to the desired level, while preventing said explosives from being contaminated with water.

In a preferred embodiment, a flexible elongate plastic sleeve having a diameter substantially similar to that of the blast hole is lowered into the bottom of a blast hole (with or without water therein) by means of a weight in a pocket near the lowermost closed end of the sleeve.

That portion of the sleeve which is beneath the water level in the blast hole collapses inwardly because of the water pressure. The top of the sleeve is coupled to the lower charging end of a pressure charger vessel by means of a pneumatic plug.

The plastic sleeve has an irregular outer surface consisting of projections and recessions. In a preferred embodiment, the projections are in the form of vertically oriented ridges and the recessions are vertically oriented grooves created between such ridges.

When pressurized air is conveyed to the plastic sleeve, the ridges on the outer surface thereof abut the inner walls of the blast hole. The pressurizing of the plastic sleeve forces the water to move outwardly and upwardly from the blast hole through the grooves on the outside surface of the liner. The pressure charger vessel is, in a preferred embodiment, comprised of a hopper-like structure into which bulk ANFO explosive can be added by any conventional means.

Situated between the pressure charger vessel and the plastic sleeve is a pneumatic pinch valve. The pressure charger vessel is also equipped with a dome-shaped loading valve below a filler funnel. When ANFO is loaded into the pressure charger vessel the dome valve is opened and the lower pinch valve is closed.

Once the pressure charger vessel is loaded with a predetermined amount of bulk ANFO, the dome valve is closed. Thereafter, pressurized air is introduced into the pressure charger vessel and the lower pinch valve opened, permitting the ANFO under pressure to flow and be pushed downwardly within the plastic sleeve. As the plastic sleeve receives the pressurized air, it changes from its collapsed state below the waterline, to its expanded state. This allows the pressurized ANFO to reach the bottom of the sleeve at the bottom of the blast hole. At the same time, the blast hole water is pressed outwardly and upwardly through the recesses created on the surface of the sleeve along the blast hole inner walls. In this manner, the blast hole can be filled with ANFO to the proper level within the plastic sleeve and contamination by water is avoided.

In optional embodiments of the invention, detonator cord dispensers are attached to the pressure charger vessel and primers attached to detonator cords can be lowered down into the plastic sleeve as the ANFO is loaded.

Present equipment used in open pit mining can be modified and for use with the present invention. The cost of converting the present equipment to create the apparatus and to use the method of the present invention is relatively inexpensive.

BRIEF DESCRIPTION OF THE DRAWINGS

The invention will be described in detail in conjunction with the following drawings wherein.

DESCRIPTION OF THE PREFERRED EMBODIMENTS

Figure 1:
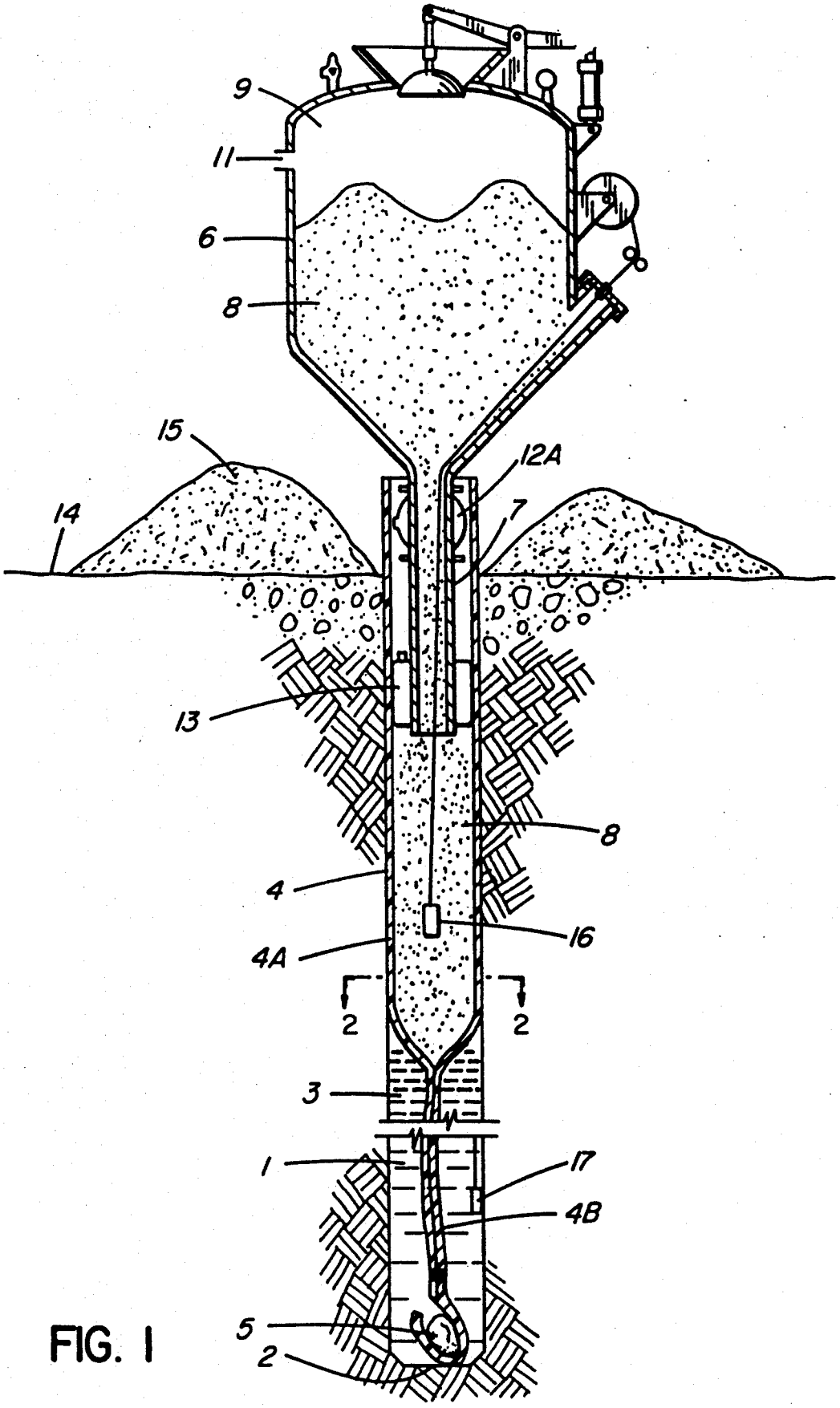
FIG. 1 is a longitudinal section taken both below and above the earth's surface through the axis of a blast hole which contains water.

In FIG. 1, a blast hole 1 has been bored below the surface of the ground 14. The drill chips and dust 15 are shown scattered about the bored blast hole. The blast hole terminates at its lowermost portion 2. In FIG. 1, the blast hole 1 has been inundated with water 3 in a large portion thereof. A plastic sleeve consisting of a waterproof liner bag 4 has been loaded into the hole by means of a weight such as a rock or drill cuttings in a pocket 5 located near the lowermost end of the liner.

FIG. 1 readily illustrates how the plastic liner bag or sleeve 4 is in an expanded condition 4A above the waterline and in a collapsed condition 4B below the waterline. Above the surface of the ground is a pressure charger vessel 6 having an elongate, lower charging tube 7 adapted to fit within plastic liner bag 4 within blast hole 1. The pressure charger vessel 6 has been loaded with ammonium nitrate fuel oil in bulk 8. The void space in the pressure charger vessel 6 is adapted to receive compressed air 9 which enters the pressure charger vessel through compressed air intake 11.

Associated with charging tube 7 is a pneumatic pinch valve 12. In FIG. 1, the pinch valve 12 is shown in the open position, permitting the ANFO 8 under pressure from compressed air 9 to flow down into plastic liner bag 4.

In order to maintain the expanded flexible liner bag 4 tightly about charging tube 7 an expanded pneumatic plug 13 is placed between the walls of the blast hole, the polyethylene liner 4A, and the charging tube 7. The plug 13 can be deflated once the loading of the polyethylene liner bag (or sleeve) is completed. Thereafter, the means of an optional detonator cord and dispenser, can also be loaded into the pressure charger vessel 6 and down into the plastic sleeve 4. A second primer 17 is also shown between sleeve 4 and the inner walls of blast hole 1.

Figure 2:
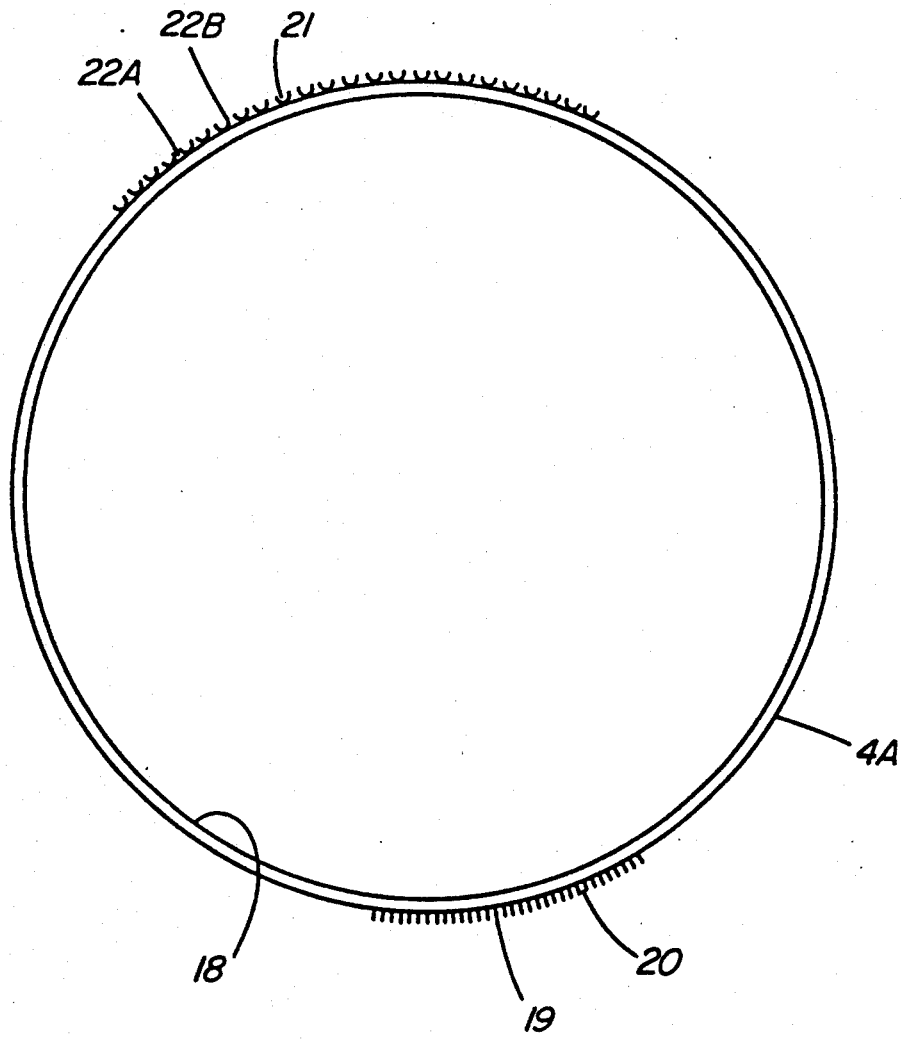
FIG. 2 is a cross-section 2—2 of the liner sleeve shown in FIG. 1.

In FIG. 2, a cross section 2—2 of FIG. 1 illustrates two alternative types of projections and recessions which can be used on the outer surface of polyethylene liner bag 4. In addition, in FIG. 2, there is an optional inner liner bag 18 of slightly smaller dimensions. The projections 19, as shown on the lower portion of the drawing, of the cross section of the liner bag in FIG. 2 are straight ribs, which when the bag is positioned in the blast hole, are vertically oriented. Recesses or grooves 20 are located between the ribs. In an alternative embodiment, the projections can be semi-circular vertically oriented ribs 22B, having recesses 22A between adjacent semi-circular ribs 22B, as well as recesses 21 within the semi-circular ribs 22B.

When the polyethylene liner bag 4 is in a pressurized condition within the blast hole 1, the remote ends of the ribs 22B or 19 are adapted to abut the inner walls of the blast hole. When the bag is in the expanded position 4A, any water which remains in the blast hole will be pressed outwardly because of the loading of pressurized ANFO into the waterproof liner bag. The water will be forced to move upwardly along the walls of the blast hole, within the grooves or recesses 20, 21, or 22A.

Figure 3:
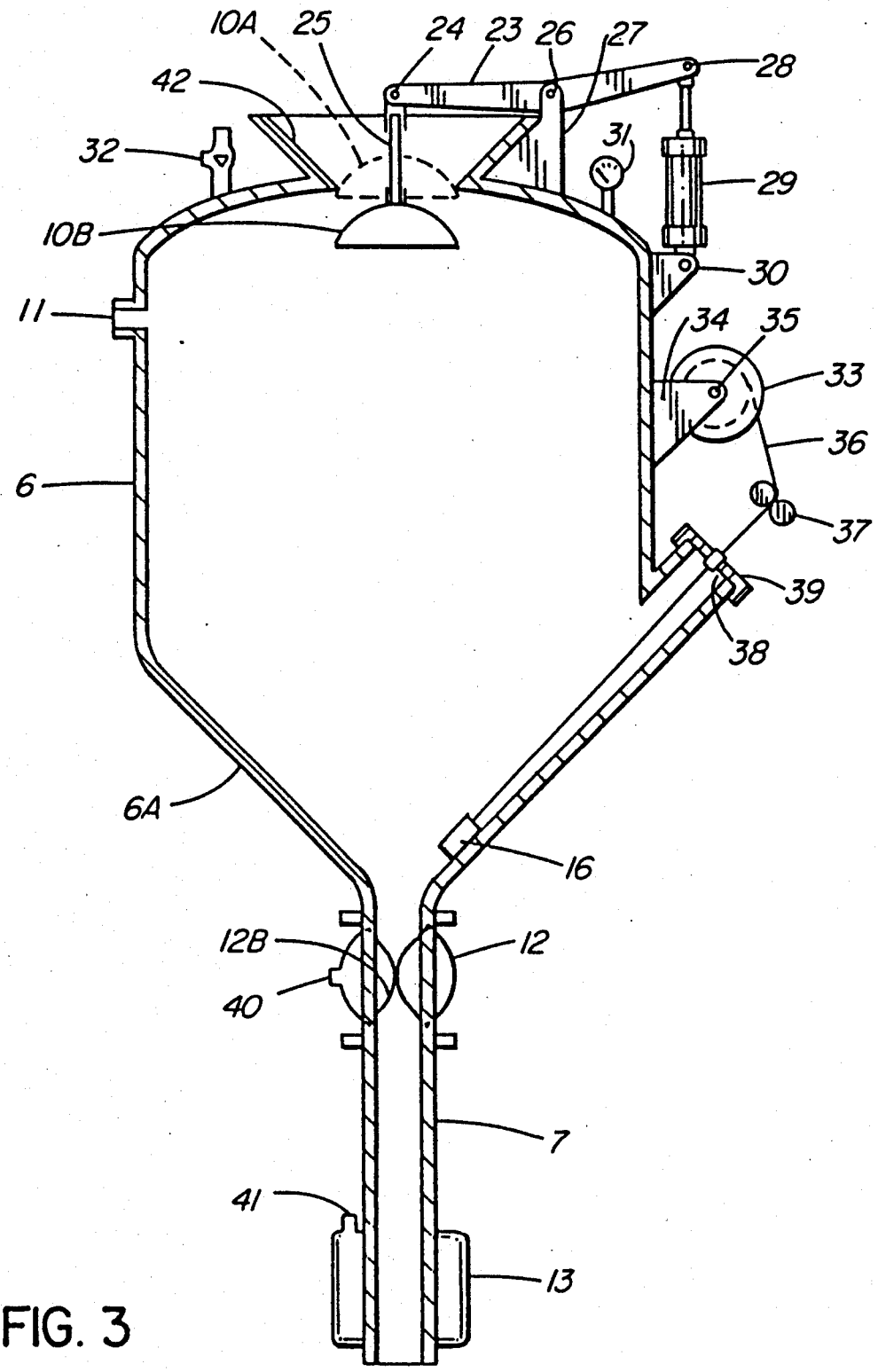
FIG. 3 is a longitudinal section of the pressure charger vessel in detail.

In FIG. 3, the pressure charger vessel 6, in longitudinal section, is shown in more detail. A dome valve 10 is shown in the open position 10B in solid lines and in the retracted closed position in dotted lines 10A. A dome valve operating lever 23 is attached to the dome valve 10, at pivot point 24. It pivots at point 26 about a bracket 27 which is affixed to the pressure charger vessel 6. Pivotally attached to the opposite end at point 28 is a pneumatic piston and cylinder 29 mounted on bracket 30. A pressure gauge 31 records the pressure within the pressure charger vessel. A pressure relief valve 32 is used as a safeguard.

In an optional embodiment, a detonator cord dispenser 33, affixed to a bracket 34, is located on the side of the pressure charger vessel 6. The dispenser revolves about point 35 permitting a cord 36, to be guided through pinch rollers 37 (which act as a depth gauge). The cord 36 is then passed through opening 38 of charger vessel 6. When pressurized air is moved into pressure charger 6, the opening 38 can be closed by removable cap 39.

Figure 4:
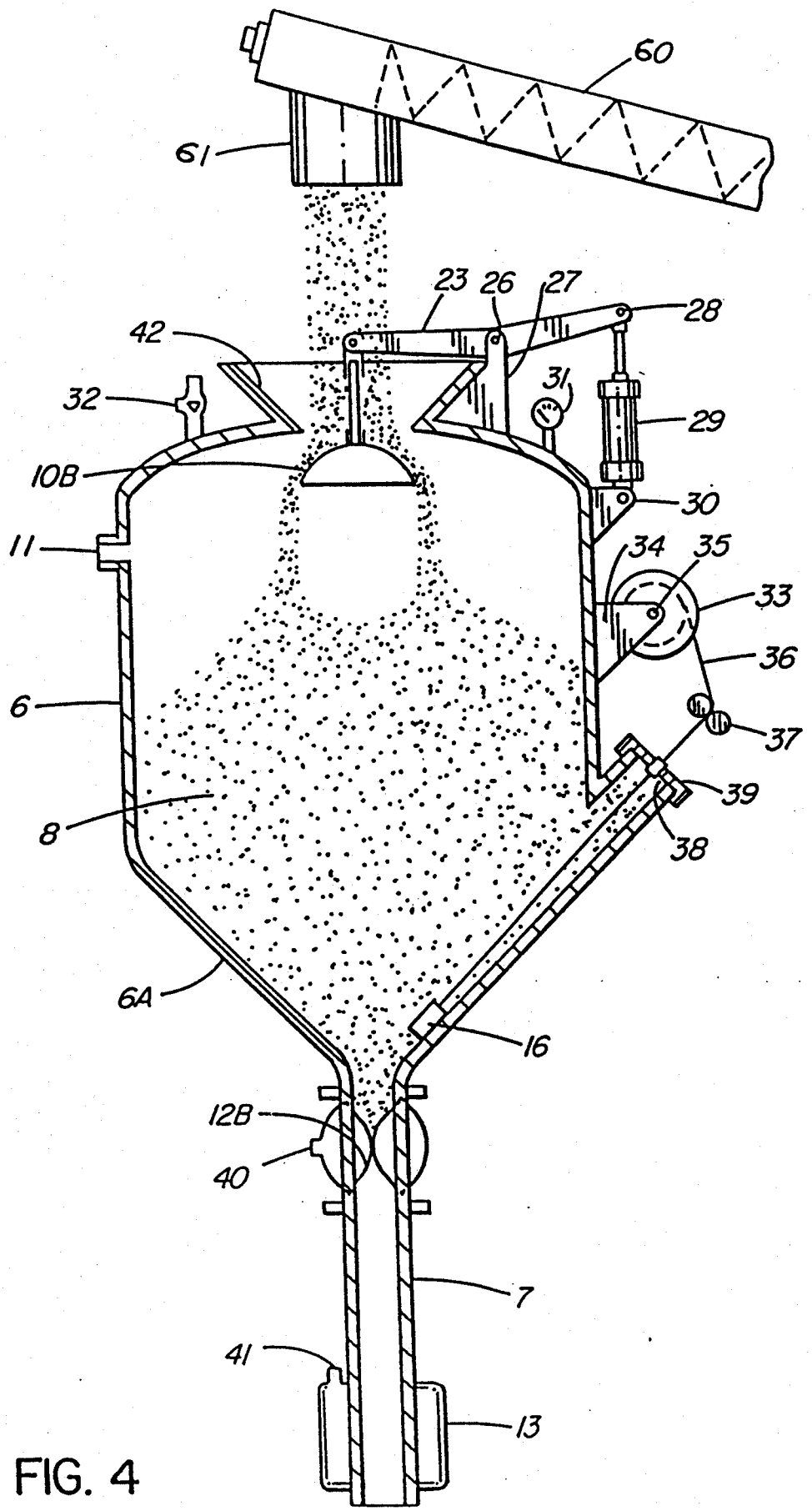
FIG. 4 is similar to FIG. 3 with the exception that the pressure charger vessel is shown being loaded with ANFO by a conventional means.

In FIG. 4, loading of the pressure charger vessel 6 is illustrated. The pneumatic pinch valve 12B is shown in the closed position and the dome valve 10 is shown in the open position 10B. A boom auger 60 distributes ANFO from a suitable source through exit 61 to filler funnel 42.

Figure 5:
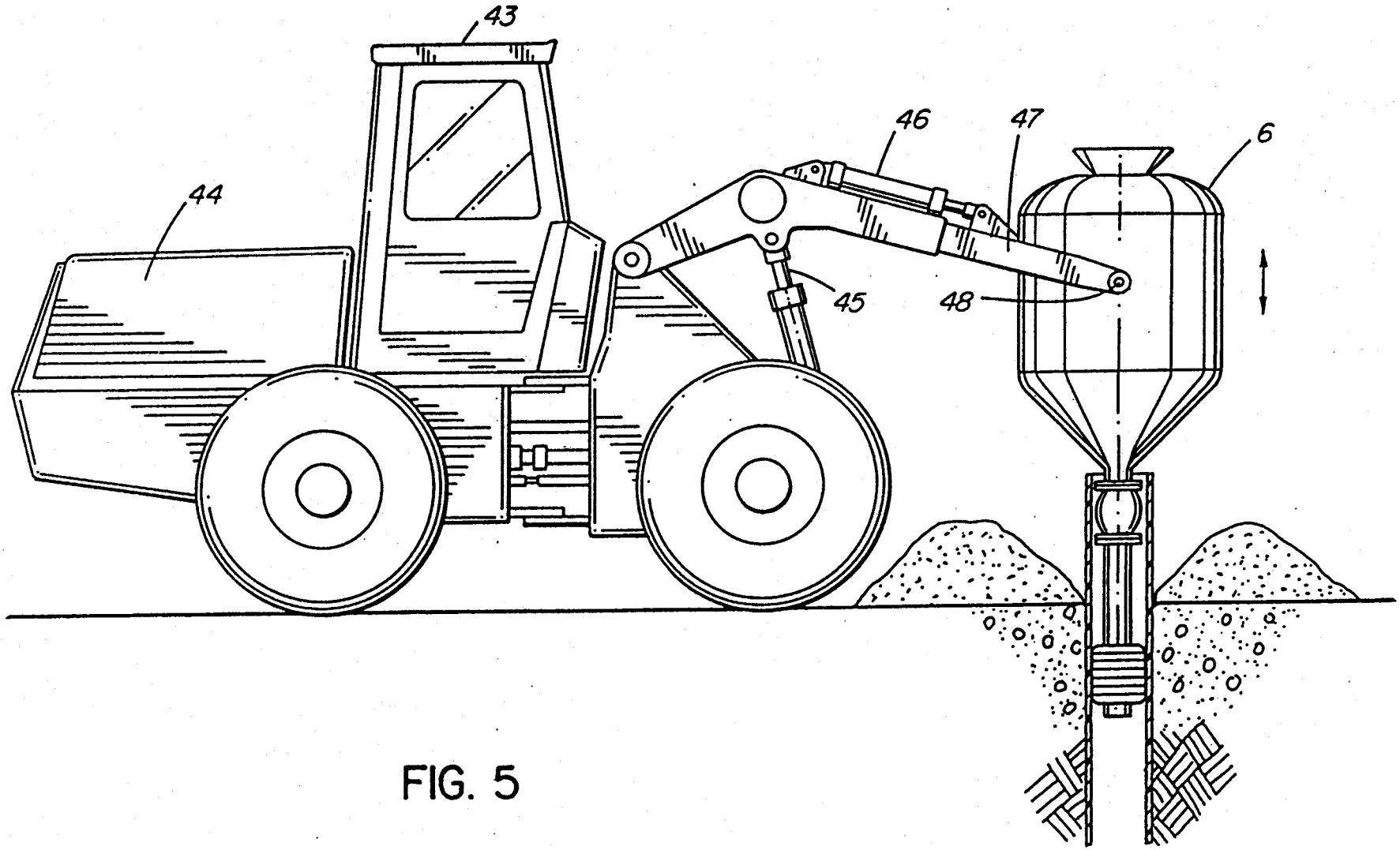
FIG. 5 is a schematic drawing, partly in section, of a mining vehicle maintaining a pressure charger vessel in position.

FIG. 5, in schematic form, illustrates a modified articulated loader 43 equipped with an air compressor 44. The front end loader arm 47 is moved in position by means of hydraulic cylinders 45 and 46. The pressure charger vessel 6 is held in position at pickup points 48.

Figure 6:
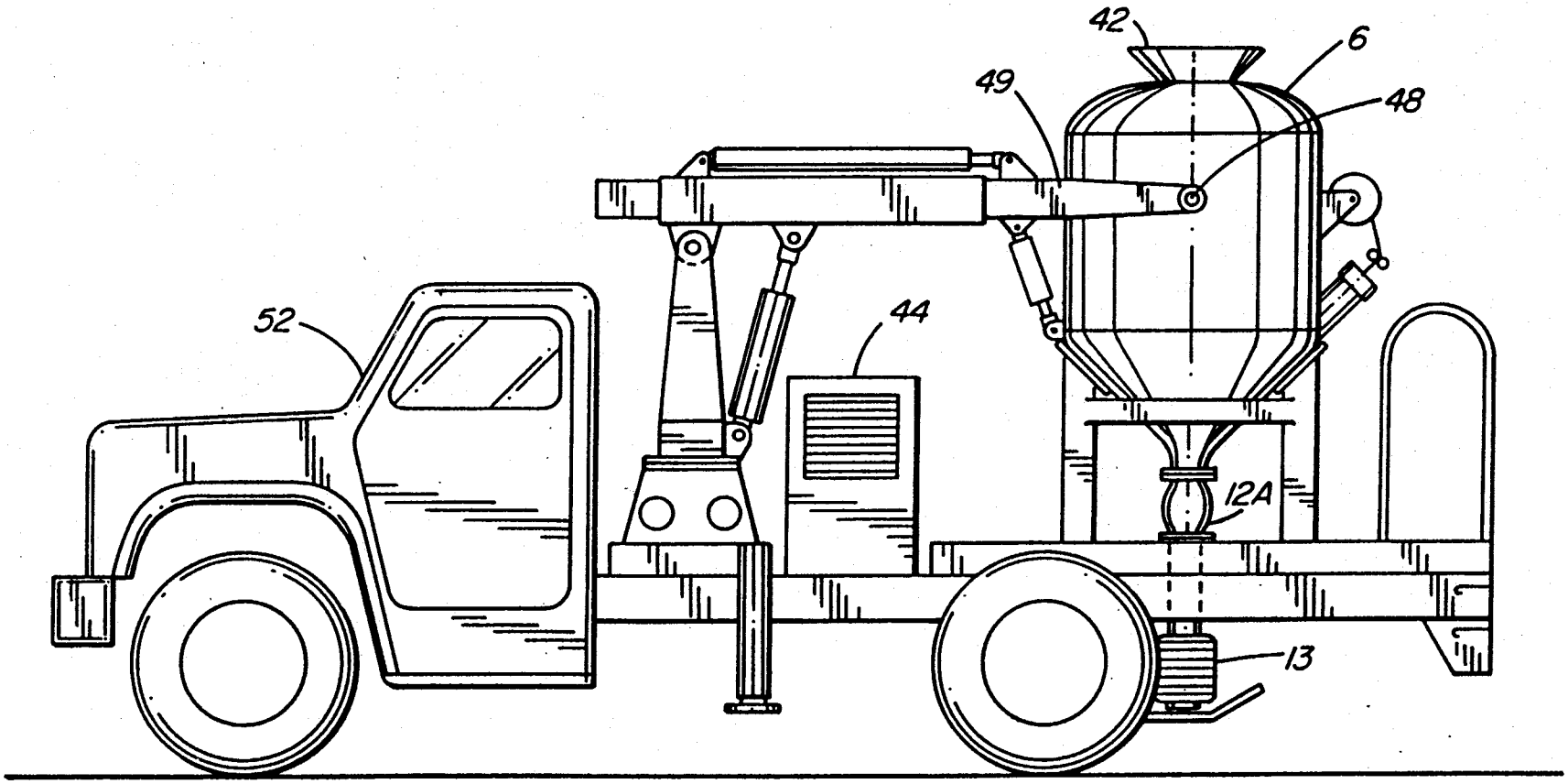
FIG. 6 is an alternative means of positioning the pressure charger vessel.

In FIG. 6, a truck 52 having a hydraulic boom 49, holds pressure charger vessel 6 at pressure point 48.

Figure 7:
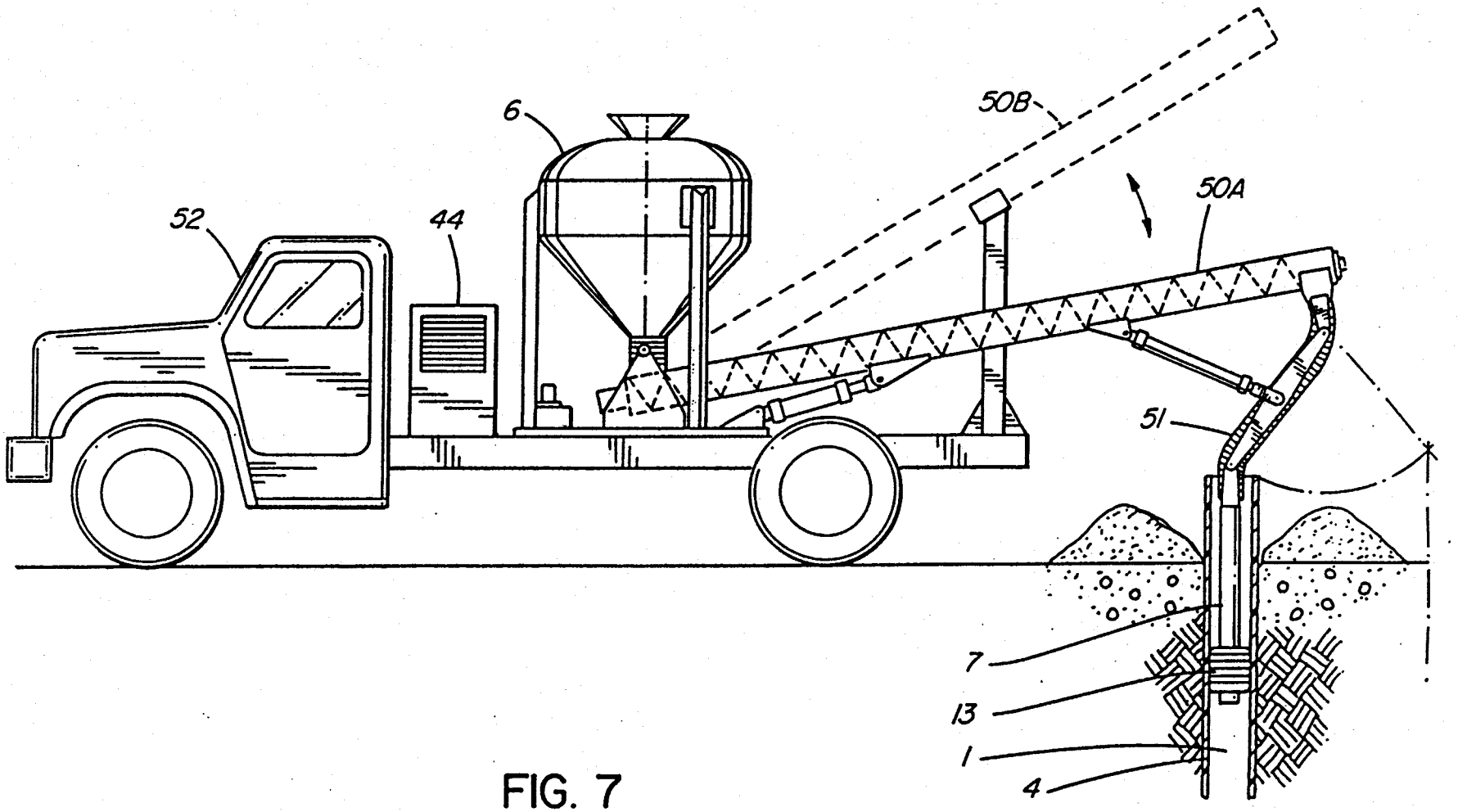
FIGS. 7 and 8 are schematic drawings partly in section of alternative means of supplying the pressurized ANFO to the plastic sleeve within the bore hole.

FIG. 7 illustrates an alternative embodiment of the 10 invention wherein the pressure charger vessel 6 is mounted on a truck 52. The boom auger in the operating position shown as 50A is pressurized and a closed pressurized circuit is maintained between the boom auger 50A, the flexible loading hose 51 and the charging tube 7. In dotted lines the pressurized boom auger is shown in a non-operative position 50B.

Figure 8:
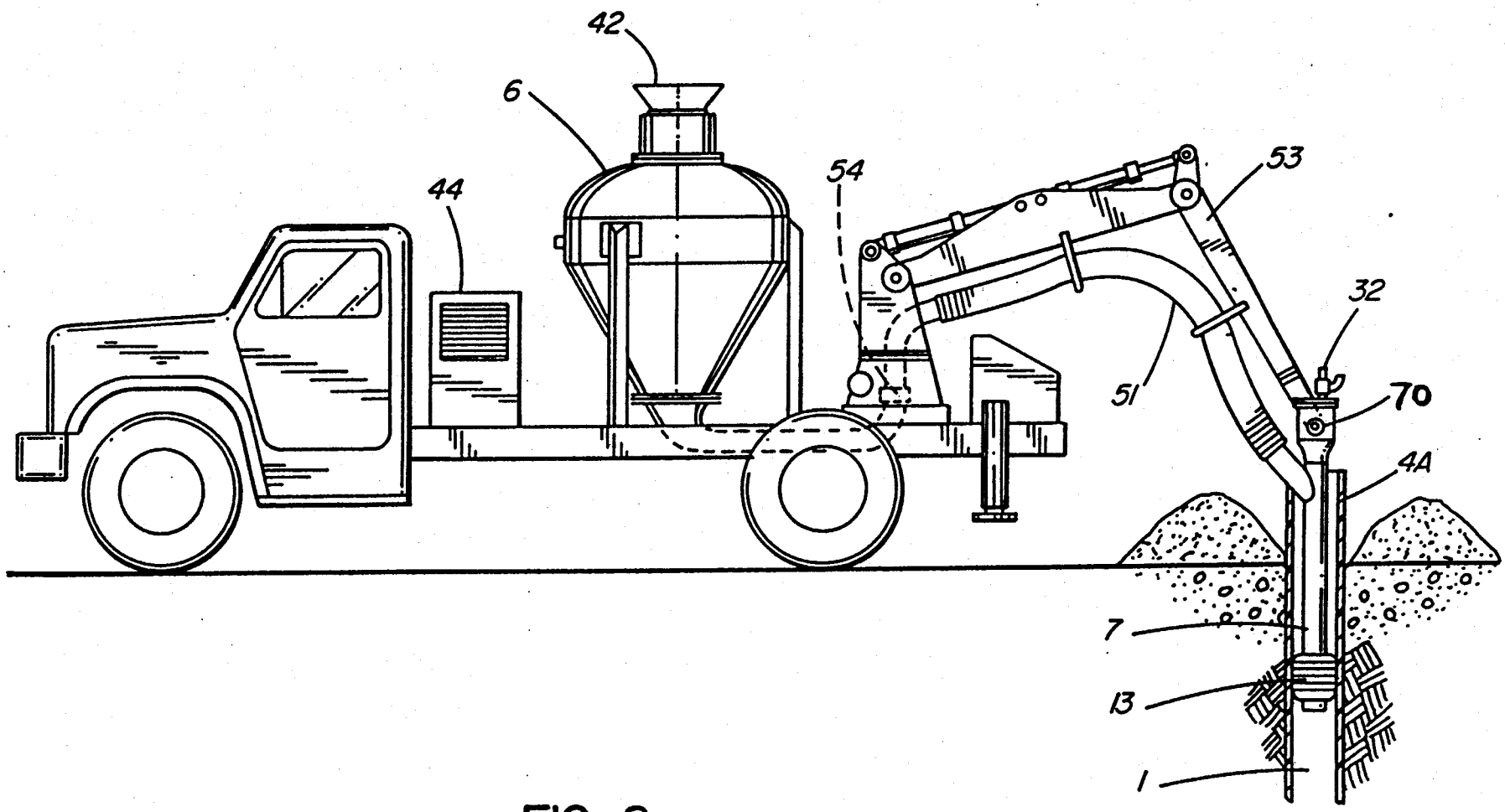

Another alternative arrangement is shown in FIG. 8, wherein a hydraulic boom 53 maintains charging hose 51 and charging tube 7 in the appropriate loading position. A filter 70 and a pressure relief valve 32 are located at the top of charging tube 7. In this embodiment, the hydraulic boom 53 can swivel about pivot point 54.

Another embodiment possible, although not shown in the drawing is the adaptation of this invention to a bulk mixing and transport truck in which the truck body would be the pressure vessel 6 and the explosive is conveyed to the blast hole by mechanical or pneumatic means as in FIGS. 7 and 8.

In operation, after a blast hole 1 is bored into the rock in an open pit mine, a waterproof (liner) sleeve 4 is loaded into the bore hole, and a weight 5, pulls the sleeve to the bottom 6 of the blast hole 1.

Thereafter, pressure charger vessel 6 is placed into position above the blast hole and charging tube 7 is inserted within the top portion of plastic sleeve 4. Plug 13 is expanded to make a fixed connection between the tube 7 and expanded sleeve 4A. Thereafter, pinch valve 12 is activated to the closed position 12B and ANFO 8 is loaded into pressure charger vessel 6 through filler funnel 42 when dome valve 10 is in the open position 10B.

Once sufficient ANFO has been loaded into the pressure charger vessel 6, dome valve 10 is moved to the closed position 10A, and pinch valve 12 is activated to the open position 12A, thereby allowing ANFO under its own weight to move downwardly in the plastic liner/sleeve to the water level in the blast hole. Compressed air 9 is then forced into the pressure charger vessel 6 through air intake 11. Once the pressure charger vessel 6 is charged with compressed air, the ANFO under pressure moves downwardly in the plastic liner/-sleeve. This causes the plastic liner/sleeve to expand outwardly to its expanded state 4A, even below the surface of the water 3. As pressurized air and ANFO are continually forced into the sleeve 4, the water 3 is pressed outwardly and vertically upwardly along the walls of the blast hole 1 through grooves 20, or alternatively, recesses 21 and 22A. These provide channels for movement of water upwards along the sidewalls of the blast hole 1.

Once loading is complete, compressed air 9 is released, pneumatic plug 13 is relaxed, pressure charger vessel 6 with charging tube 7 is removed and plastic liner sleeve 4 is closed at the top to prevent any contamination of the ANFO. At the desired time, the ANFO within plastic liner sleeve 4 is detonated, resulting in an explosion.

It is to be understood that the apparatus and method shown in the present invention can work equally well with other types of explosives, (other than ANFO) and can be used for inclined or vertically oriented blast holes in the same manner. The invention thus described is a low cost efficient alternative method for charging blast holes which cannot be or are not de-watered.

I claim:

1. An apparatus for loading bulk explosives into a cylindrical blast hole comprising:

a pressure charger vessel adapted to be filled with bulk explosives and pressurized with compressed air;

at least one water impervious cylindrical flexible sleeve adapted to be lowered into a blast hole and connected to said pressure charger vessel;

said flexible sleeve including an irregular outer surface with recessions and projections; said projections adapted to abut inner walls of said blast hole;

a pressure means adapted to convey pressurized air into said pressure charger vessel and said sleeve; and a conveying means adapted to convey bulk explosives into said pressure charger vessel;

wherein, when in operation, pressurized air is conveyed into said pressure charger vessel, and said sleeve is expanded to substantially fill said blast hole, said sleeve is filled with bulk explosives and pressurized air, simultaneously forcing any water in of said blast hole and said recessions on the outer surface of said sleeve, thereby permitting said sleeve to be filled with explosives to the desired level, while preventing said explosives from being contaminated with water.

2. An apparatus as claimed in claim 1 wherein said sleeve is comprised of waterproof flexible plastics and said projections and recessions on said outer walls, are vertically oriented ridges and grooves, respectively.

3. An apparatus as claimed in claim wherein said pressure charger vessel includes a downwardly directed charging tube;

being adapted to fit within an open end of said flexible sleeve; and said valve means being adapted to prohibit, or permit the flow of bulk explosives and pressurized air, from said charger vessel to said flexible sleeve.

4. An apparatus as claimed in claim 3 further comprising a pneumatic expanding plug;

said plug adapted, in operation, to temporarily seal the connection between said sleeve and said charging tube by exerting pressure against the inner walls of said blast hole, when said plug is in the expanded state.

5. An apparatus as claimed in claim 3 wherein said pressure charger vessel includes an upper dome valve and a filler funnel;

said upper dome valve being adapted to open when said pressure charger is being filled with bulk explosives by said conveying means; and said valve adapted to be closed when said pressure charger and said sleeve are being supplied with pressurized air by said pressure means.

6. An apparatus as claimed in claim wherein said pressure charger vessel includes a pressure relief valve, a pressure gauge, a pneumatic operator for said dome valve, and a dome valve operating lever.

7. An apparatus as claimed in claim 6 wherein said pressure charger vessel includes a detonator cord dispenser, pinch rollers with a depth gauge, and a removable cap with seal.

8. An apparatus as claimed in claim I including both an inner flexible sleeve and an outer flexible sleeve, said inner sleeve being of smaller diameter than said outer sleeve;

said outer flexible sleeve having projections and recesses;

said projections comprising semi-circular ribs, which extend vertically when said sleeve is in an operative position in said blast hole.

9. An apparatus as claimed in claim wherein said projections on said sleeve are outwardly extending ribs, which extend vertically when said sleeve is in an operative position in said blast hole.

10. An apparatus as claimed in claim 1 wherein said pressure charger vessel includes a port for compressed air intake and outlet;

said air compressor being adapted to be connected to said port by a suitable connecting means.

11. An apparatus as claimed in claim wherein said conveying means includes a boom auger which is in communication with a truck box filled with bulk explosives.

12. An apparatus as claimed in any one of claims 1 or 3 wherein said pressure means and said conveying means in combination comprise a pressurized boom auger;

said boom auger being adapted to convey bulk explosives and pressurized air directly into said charging tube and said sleeve.

13. An apparatus as claimed in claim i wherein said sleeve includes a pocket on the lowermost end;

said pocket being adapted to contain a weight;

wherein, when in operation, said sleeve is lowered into said blast hole, said weight pulls said sleeve downwardly such that a lowermost, closed end of said sleeve rests on the bottom of said blast hole.

14. A method for loading bulk explosives into blast holes comprising the steps of:

(1) lowering a weighted elongate water impermeable flexible plastic sleeve into a blast hole;

(2) fixedly connecting said plastic flexible sleeve to a charging tube by means of a pneumatic plug;

(3) loading a pressure charger vessel with bulk explosives by means of a conveying means;

(4) introducing pressurized air into said pressure charger vessel;

(5) opening a valve between said charging tube and said flexible sleeve such that pressurized air and said bulk explosives enter said sleeve located in said blast hole;

(6) permitting said sleeve to expand outwardly such that projections on said sleeve's outer surface contact the edges of said blast hole, thus permitting any water in said bore hole to be pushed outwardly and upwardly along the inner walls of said blast hole;

(7) sealing said sleeve at the top portion thereof in preparation for detonation.

* * * * *